US008201531B2

(12) United States Patent
Pattakos et al.

(10) Patent No.: US 8,201,531 B2
(45) Date of Patent: Jun. 19, 2012

(54) DESMODROMIC VARIABLE VALVE ACTUATION

(76) Inventors: Manousos Pattakos, Nikea Piraeus (GR); John Pattakos, Nikea Piraeus (GR); Emmanouel Pattakos, Nikea Piraeus (GR)

( * ) Notice: Subject to any disclaimer, the term of this patent is extended or adjusted under 35 U.S.C. 154(b) by 347 days.

(21) Appl. No.: 12/663,275

(22) PCT Filed: Jun. 6, 2008

(86) PCT No.: PCT/IB2008/052228

§ 371 (c)(1), (2), (4) Date: Dec. 5, 2009

(87) PCT Pub. No.: WO2008/149316

PCT Pub. Date: Dec. 11, 2008

(65) Prior Publication Data

US 2010/0162978 A1 Jul. 1, 2010

(51) Int. Cl.
*F01L 1/30* (2006.01)

(52) U.S. Cl. ..... 123/90.24; 123/90.16

(58) Field of Classification Search ..... 123/90.24, 123/90.15, 90.16
See application file for complete search history.

(56) References Cited

U.S. PATENT DOCUMENTS 6,227,154 B1 * 5/2001 Wakeman ..... 123/90.16
2004/0226525 A1 * 11/2004 Naumann ..... 123/90.16
* cited by examiner

*Primary Examiner* — Zelalem Eshete

(57) ABSTRACT

A mechanical desmodromic fully variable valve actuation system capable for racing revs. Valve lift and valve duration continuously variable from a maximum to zero. Independently variable valve duration and valve lift.

9 Claims, 19 Drawing Sheets

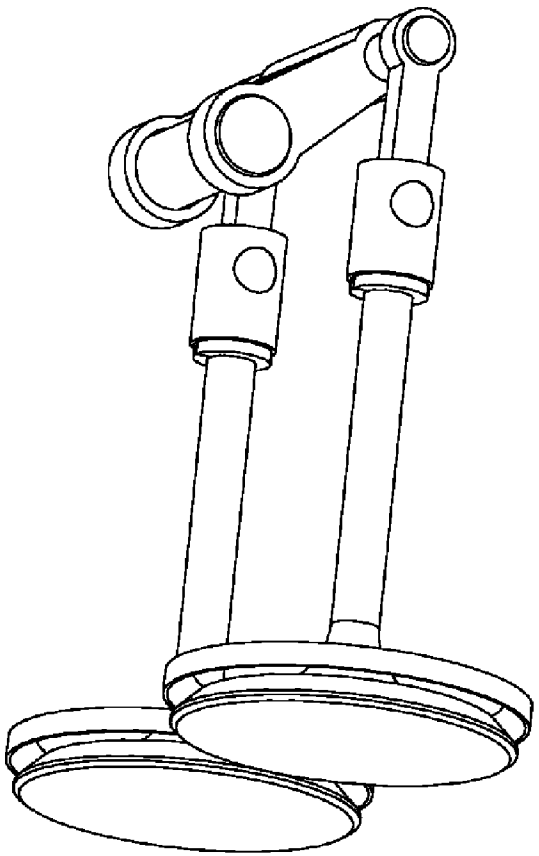
Fig. 9
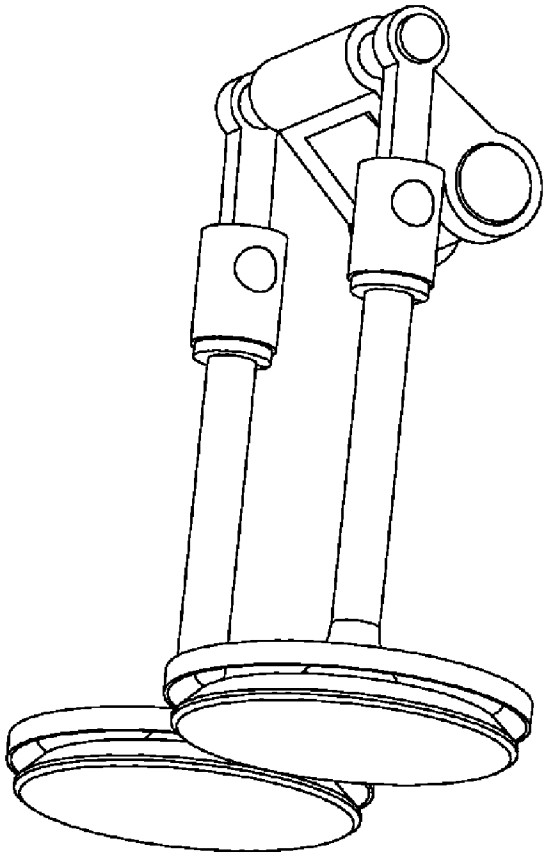

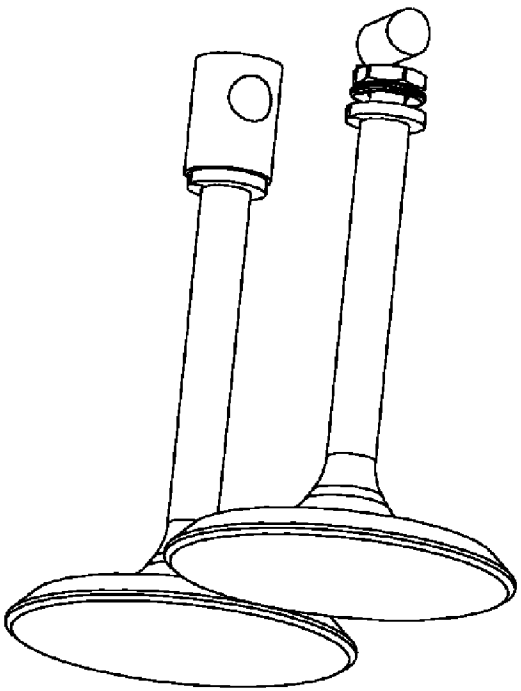
Fig 10
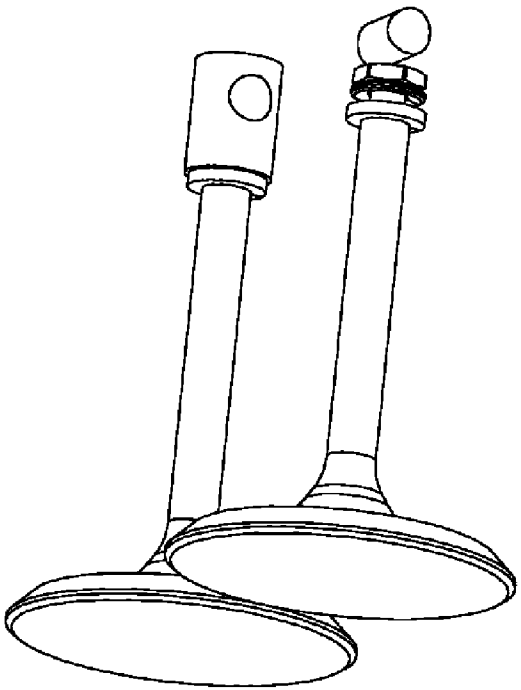

DESMODROMIC VARIABLE VALVE ACTUATION

The closest prior art is the U.S. Pat. No. 6,892,684. Instead of actuating the central swivel joint by a cam lobe, in the present invention the swivel joint is actuated positively in both directions by a link having a drive pin mounted at one end, the drive pin being engaged in a track to reciprocate therein. The resulting valve mechanism is rid of restoring springs of any kind, it operates reliably at racing revs because it is rid of heavy fast moving parts like the track, and it is fully variable: it can change continuously and independently the valve duration and the valve lift from a maximum value to even zero, i.e. it can better approach the ideal valve lift profile for the instant operational conditions of the engine in terms of revs, load, air temperature, coolant temperature, fuel quality, driving mode, altitude etc, i.e. it can optimize the operation and the thermal efficiency along a wider rev and load range.

Desmodromic variable valve actuation (VVA) is described in U.S. Pat. No. 4,898,130 and U.S. Pat. No. 5,016,581 (Jaguar-Parsons) patents, wherein a rotating eccentric pin drives, via a link, a drive pin engaged in a track formed on a rocker arm. Desmodromic VVAs are also described in U.S. Pat. No. 6,053,134 (Linebarger), in PCT/US2006/026429 (Decuir), in PCT/AU1998/000090 (Armstrong) etc.

FIGS. 4 to 10 show the mechanism of FIG. 3 after the removal of some parts to reveal the inner parts.

Figure 1:
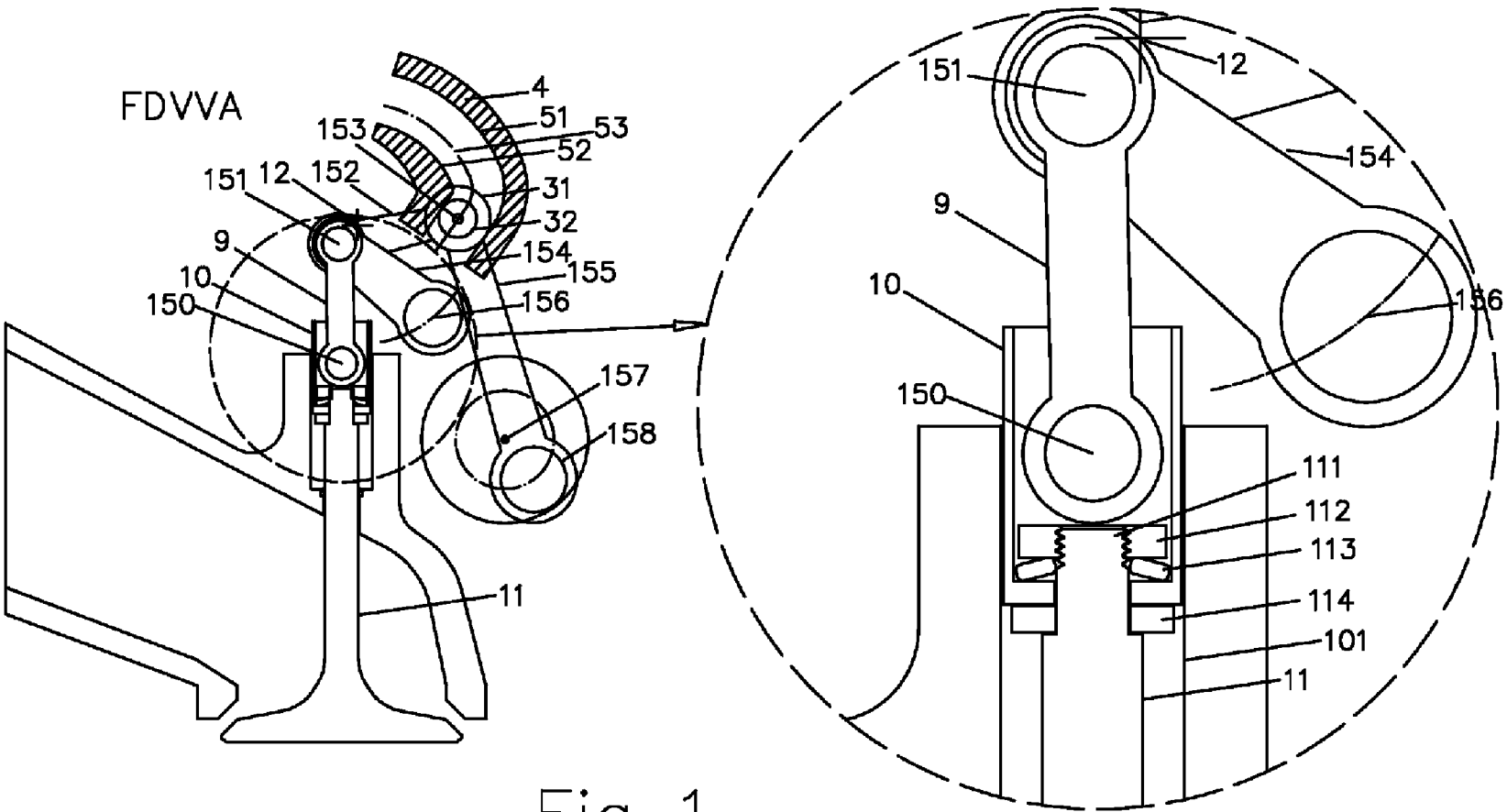
FIG. 1 shows a preferred embodiment.

FIG. 1 shows, in cross-section, a cylinder head with an inlet valve 11 slidably located in a valve guide. The valve 11 comprises a valve stem and a valve head, the latter being arranged to engage against a valve seat to close a port. A valve actuator 10 is slidably fitted in a guide 101. Means, like nut 112, lash adjustment washer 114 and elastic washer 113 are also provided to accommodate the valve lash adjustment and the thermal expansion and to assure the sealing of the valve against its seat when the valve is closed.

A track 4 is provided having a lost motion portion and an actuation portion. Track 4 is pivotally mounted about a pivot at 12. A first link 9 is pivotally mounted at one end about a pivot 150 on the valve actuator 10. The link 9 is pivotally mounted at its other end about a pivot 151.

A second link 154 is pivotally mounted at one end about the pivot 151. The link 154 is pivotally mounted at its other end to a pivot 156.

A third link 152 is pivotally mounted at one end about the pivot 151. At the other end of the link 152 is mounted a drive pin 31-32, the drive pin 31-32 engaging in the track 4. The separation between the drive pin 31-32 and the pivot 151 is equal to the radius of the lost motion portion of the track 4, and when the valve 11 is closed, the pivot 151 is located at 12 such that the drive pin 31-32 will move freely around the lost motion portion of the track 4.

A crankshaft 157 has a crank 158 thereon; the crank 158, via a fourth link 155, displaces the drive pin 31-32 along the track 4.

Rotation of the crankshaft 157, which may be driven in suitable manner from the engine, will thus cause the linkage 155, 152 to oscillate causing drive pin 31-32 to reciprocate along the track 4. While the pin 31-32 engages the lost motion portion of track 4, the valve will remain closed. However, when the pin engages the actuation portion of the track 4, it causes the linkage 154, 9 to oscillate causing valve 11 to open positively and to close positively.

The opening and closing point of the valve 11 will correspond to when the drive pin 31-32 will pass from the lost motion portion of track 4 to the actuation portion of track 4 and from the actuation portion of the track 4 back to the lost motion portion of track 4. The angular displacement of the track 4 about 12 changes the opening and closing point of the valve and provides variable valve duration from a maximum to even zero if desirable.

The angular displacement of the pivot 156 about 12 changes the valve lift and provides variable valve lift from a maximum to even zero, if desirable.

This way the system is fully variable, i.e. after selecting the desirable valve duration by proper angular displacement of the track 4 about 12, the angular displacement of the pivot 156 about 12 changes continuously the valve lift without affecting the valve duration, i.e. the system can change independently the valve lift and the valve duration.

The necessarily heavy track 4 moves only when a different valve duration is desirable. This way the track 4, which is the heaviest part of the mechanism, stays substantially immovable during an engine cycle.

To achieve reliable, low friction, high accuracy operation of the valve train at high revs, the mechanism does not involve heavy parts, like track 4, that move or reciprocate at valve revs.

The valve stem is free of bending loads.

Figure 13:
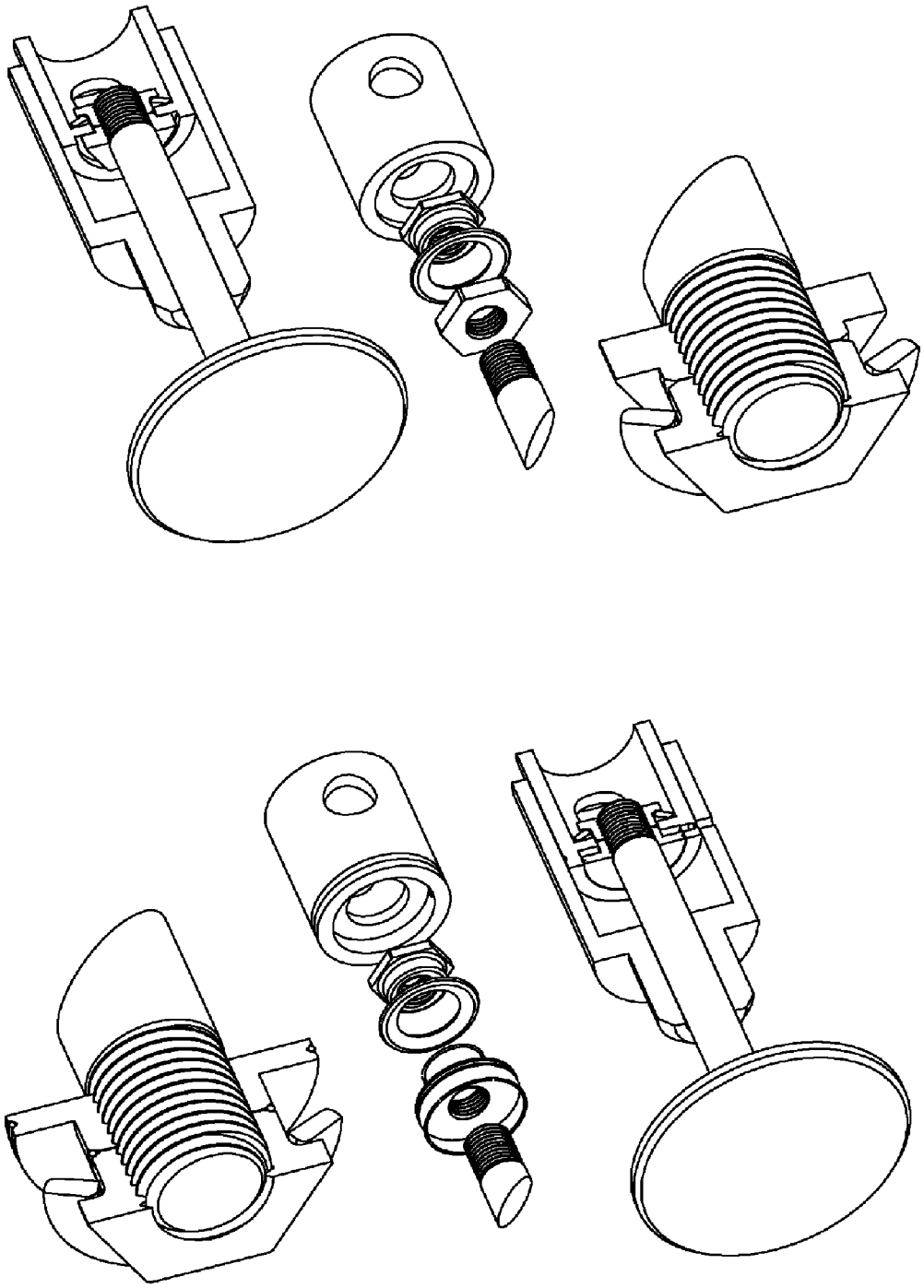
FIG. 13 shows at top a mechanical valve lash adjuster and at bottom a hydraulic valve lash adjuster.
Figure 14:
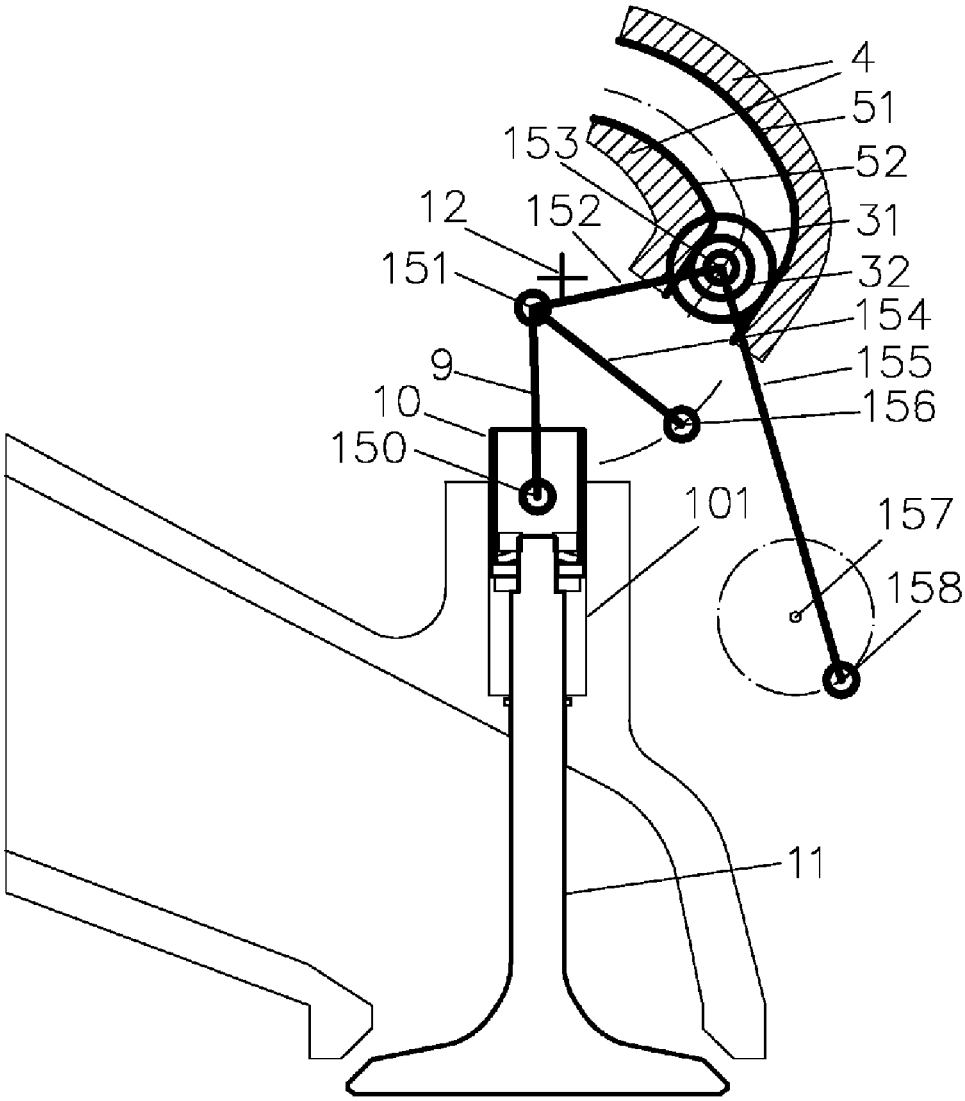
FIG. 14 shows the mechanism of FIG. 1 simplified.

The valve lash adjustment is either mechanical or hydraulic, FIG. 13.

Keeping the rest mechanism the same and changing only the geometry of the track 4, consisting of the abutment surfaces 51 and 52, a basic valve lift profile can be adjusted to a desirable form. Then, by proper angular displacement of the track 4 and of the pivot 156, the basic valve lift profile is modified to meet the instant needs of the engine. Every single point of the hatched area in FIG. 20 is achievable providing a different mode of operation, and for every mode of operation the lash, the acceleration and the jerk of the valve can stay acceptably small.

Figure 20:
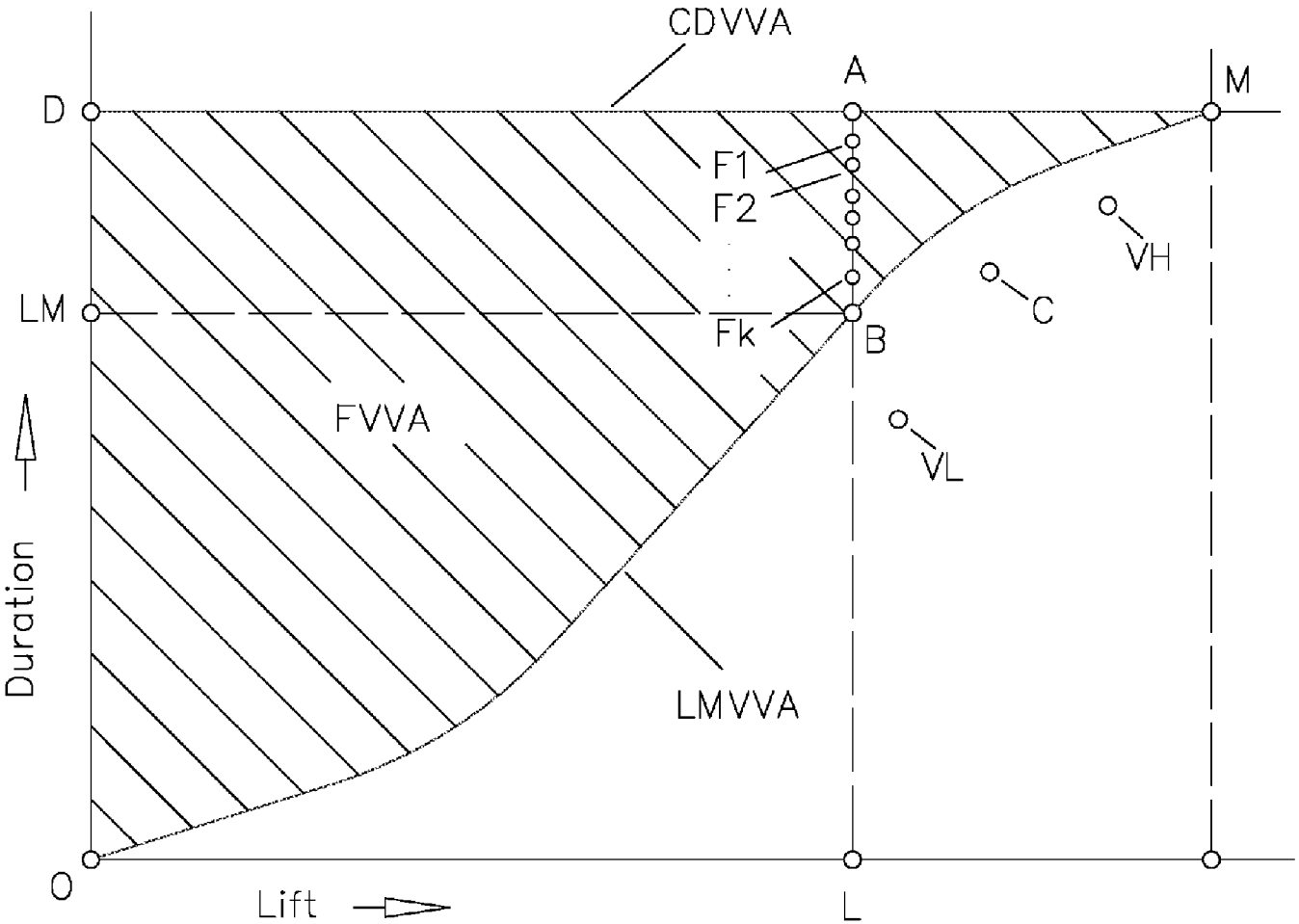
FIG. 20 shows the variability of the various valve trains in a lift-duration plot.
Figure 21:
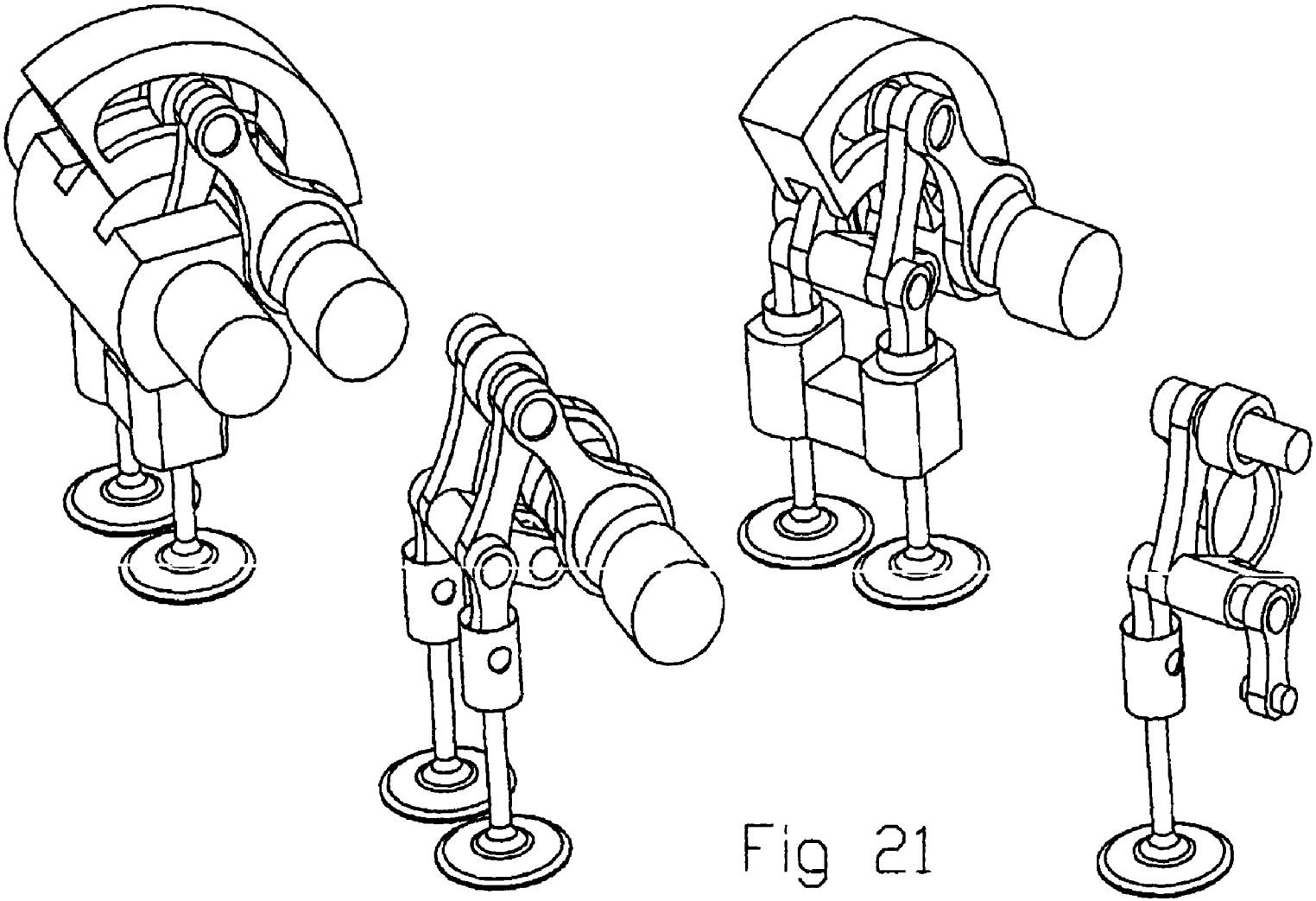
FIG. 21 shows the basic parts of a prototype cylinder head exhibited at International Engine Expo 2008, May 6 to 8, Stuttgart, Germany, details at www.pattakon.com.

Keeping both, the track 4 and the pivot 156, immovable, the system degrades down to a single mode desmodromic valve train, represented by a point like C in FIG. 20 plot.

Keeping the track 4 immovable and simply displacing angularly the pivot 156 about 12, the proposed system degrades down to a constant duration continuously variable lift valve train, represented by a line like CDVVA in FIG. 20 plot, similar to the closest prior art.

Keeping the pivot 156 immovable and simply displacing angularly the track 4 about 12, the proposed system degrades down to a lost motion continuously variable lift and duration valve train, represented by a curve like LMVVA in FIG. 20 lot, similar to BMW's valvetronic.

Figure 2:
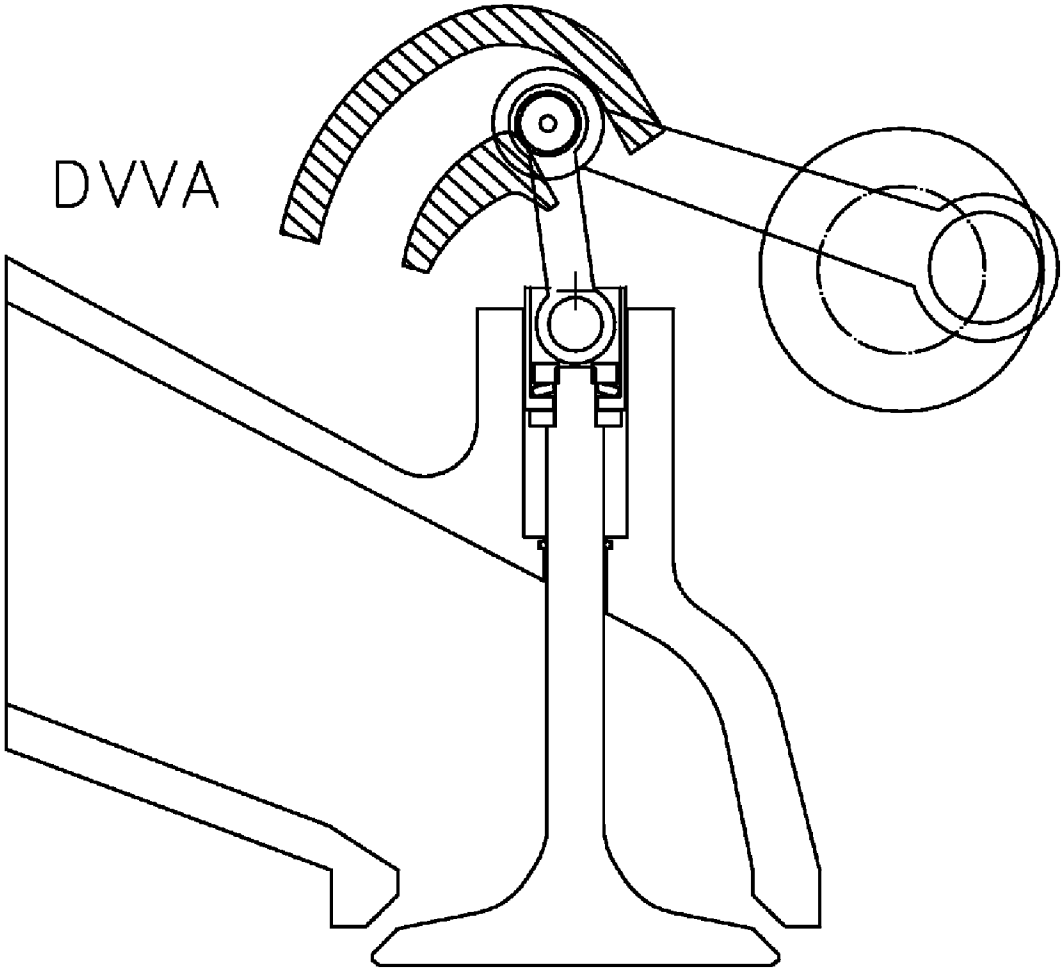
FIG. 2 shows a simplified Lost Motion version.
Figure 3:
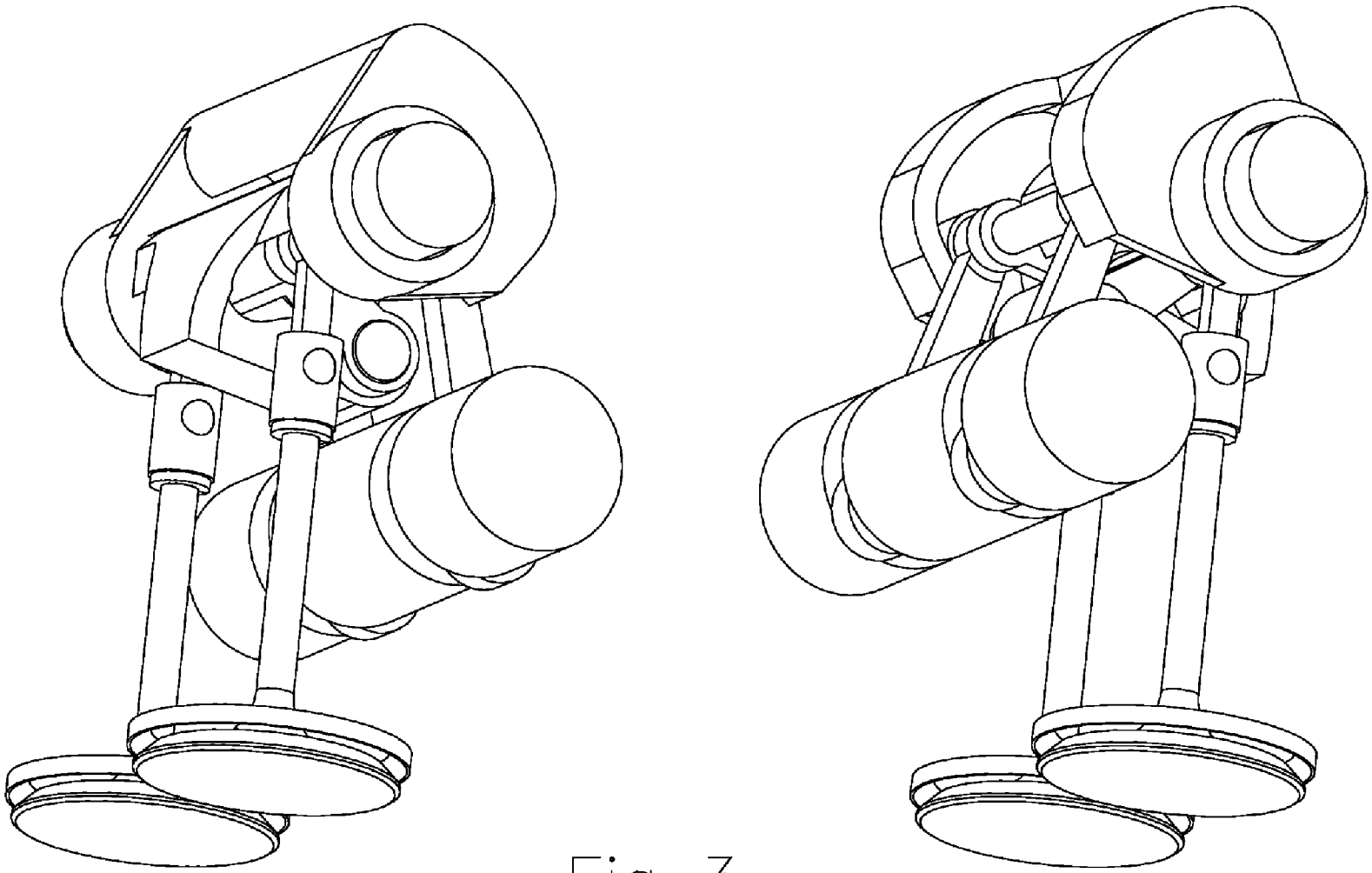
FIG. 3 shows, from two different points of view, a desmodromic fully variable valve actuation mechanism applied on a pair of valves.
Figure 4:
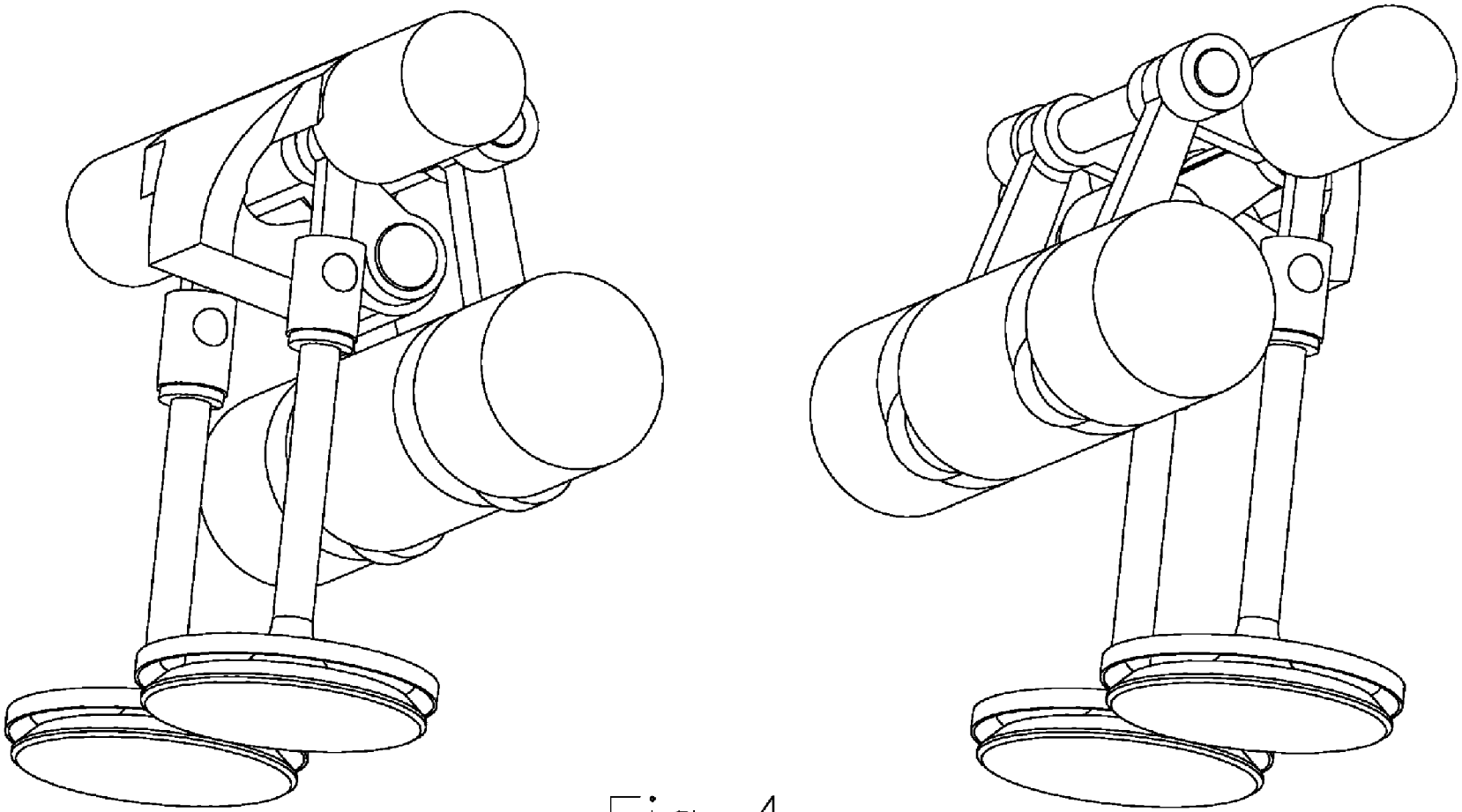
Figure 5:
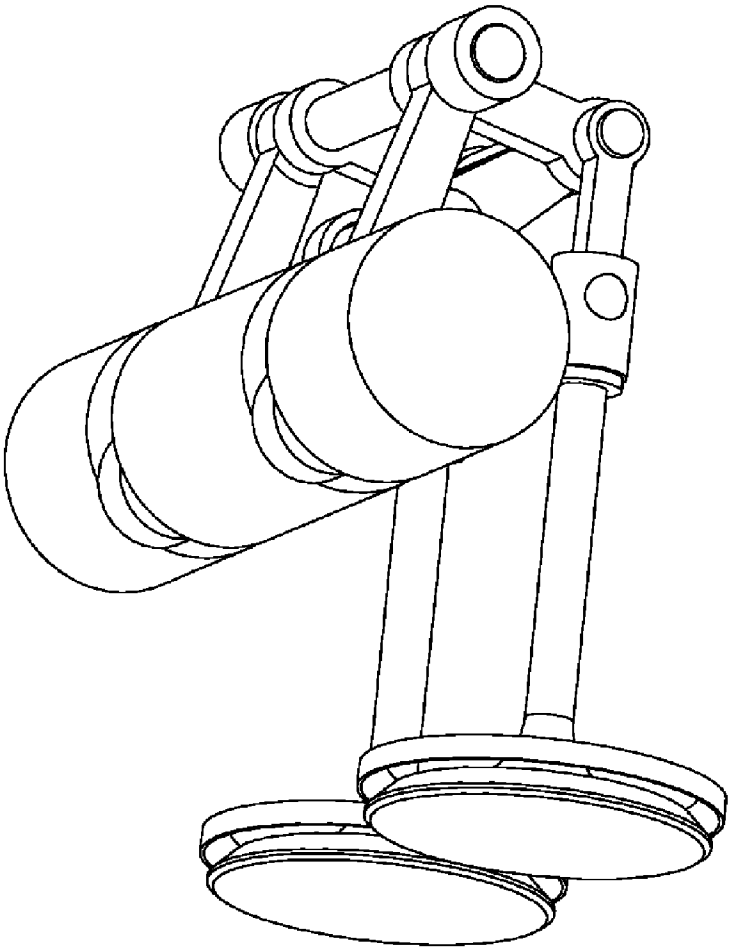
Figure 5:
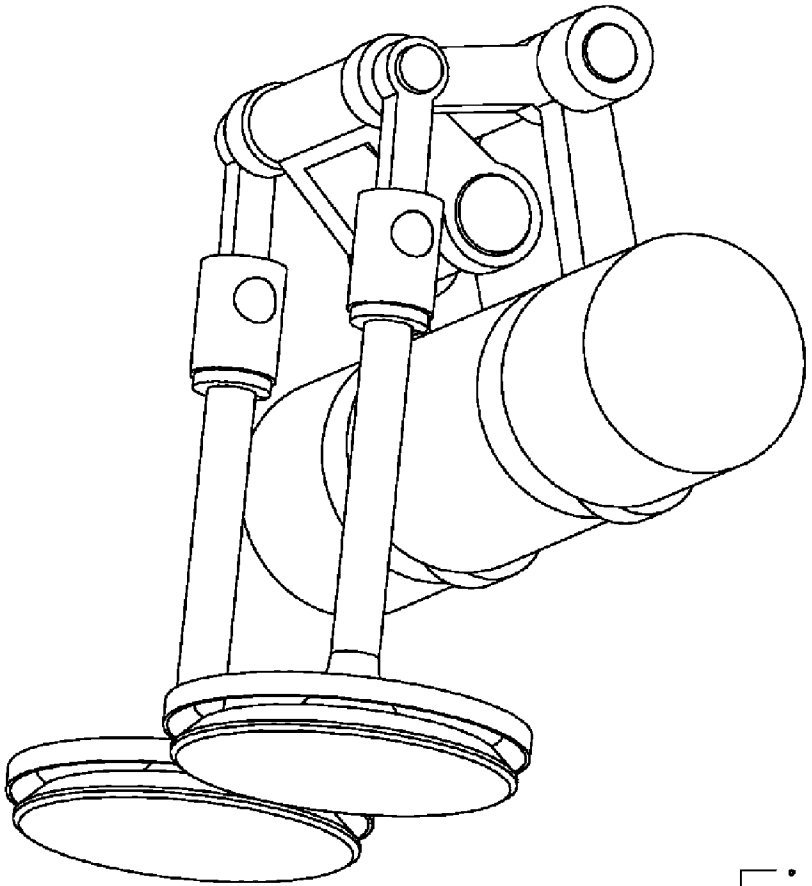
Figure 6:
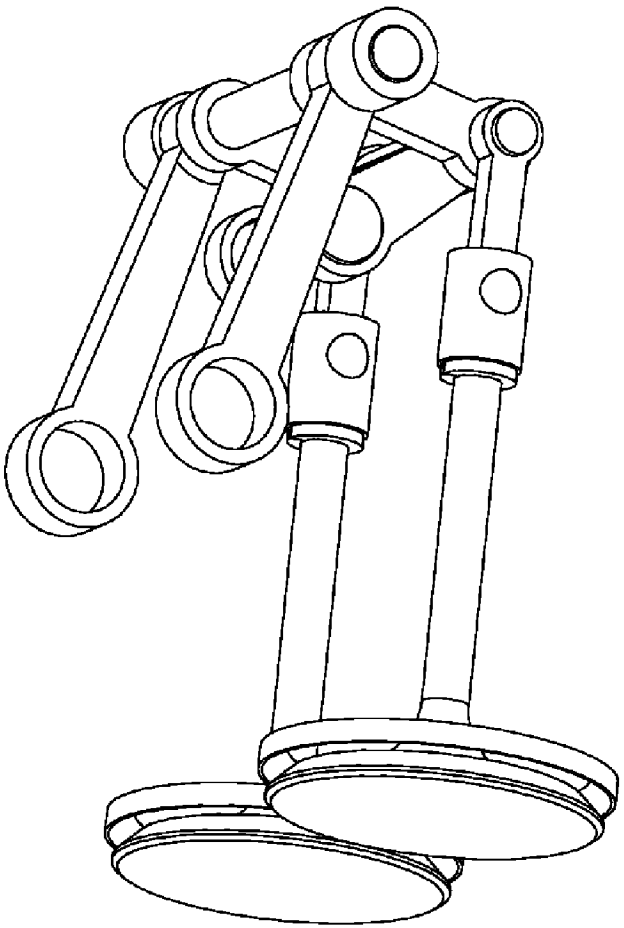
Figure 6:
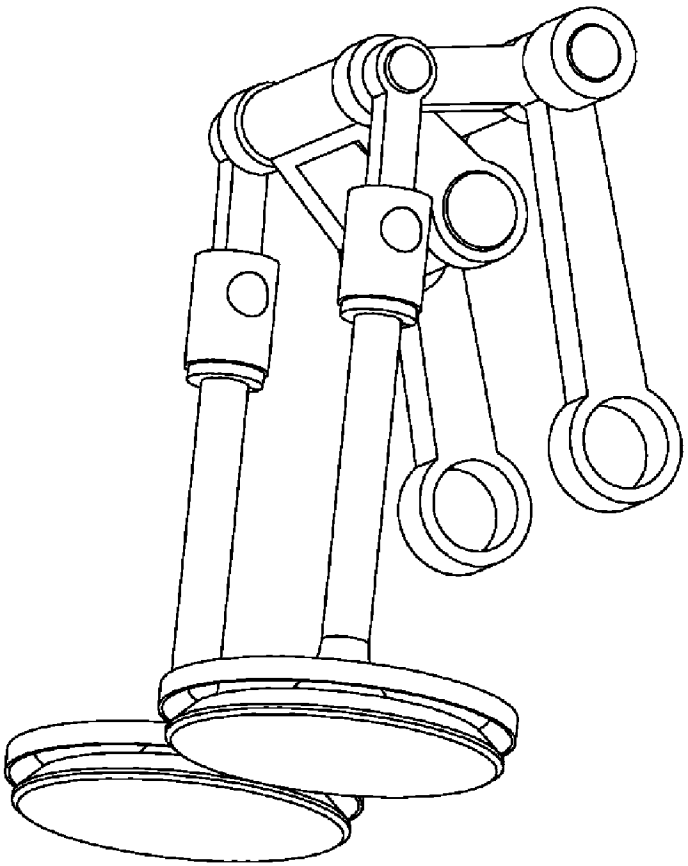
Figure 7:
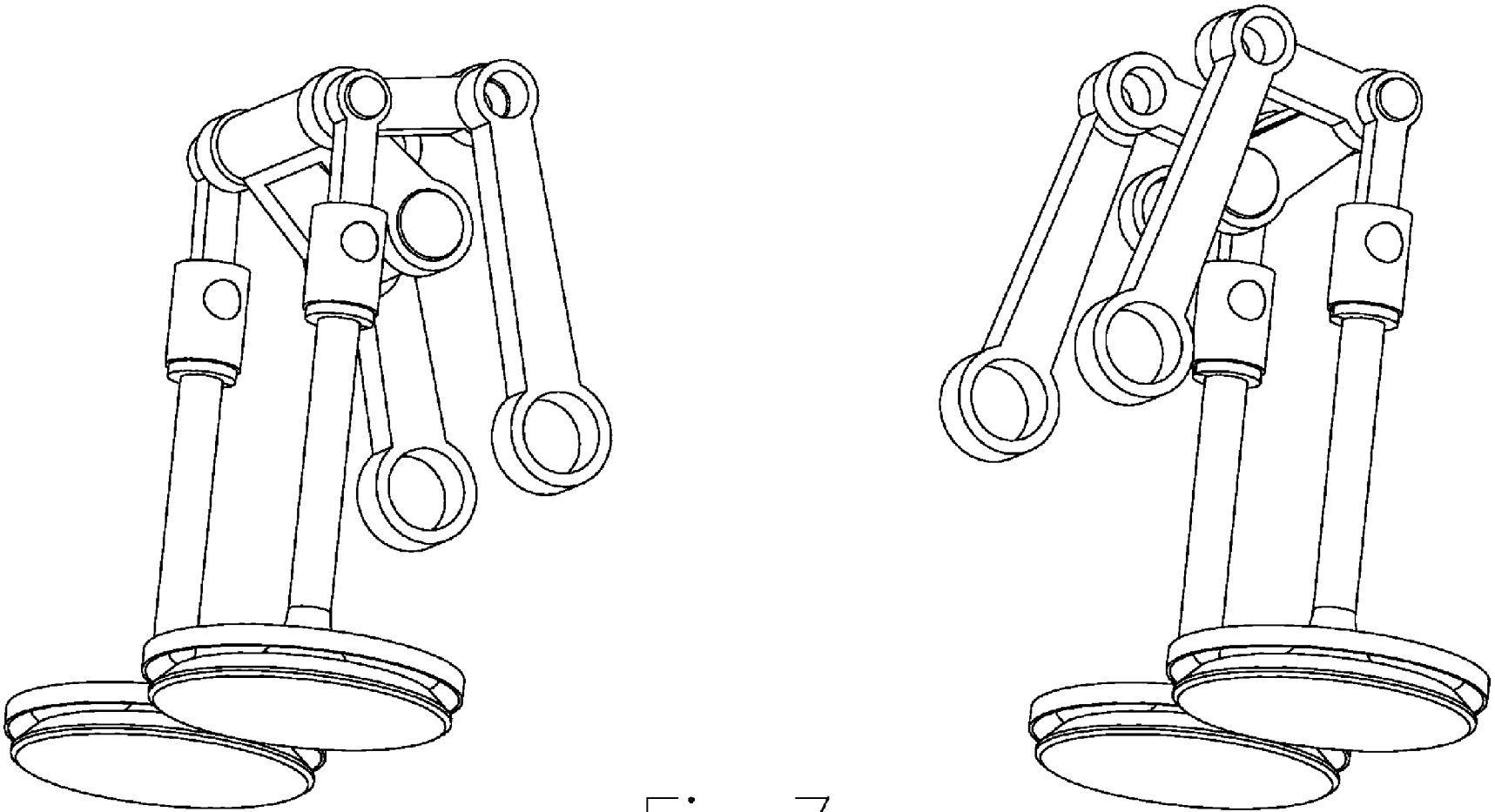
Figure 8:
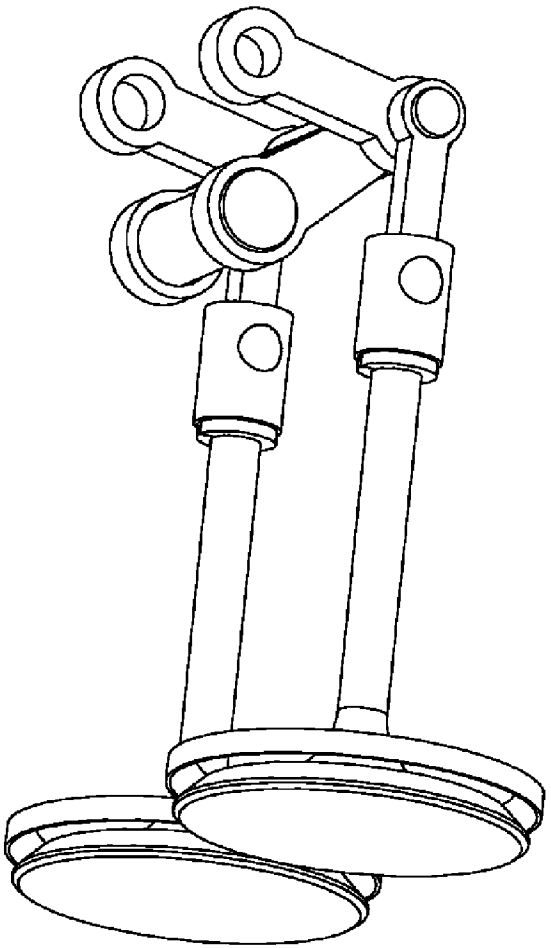
Figure 8:
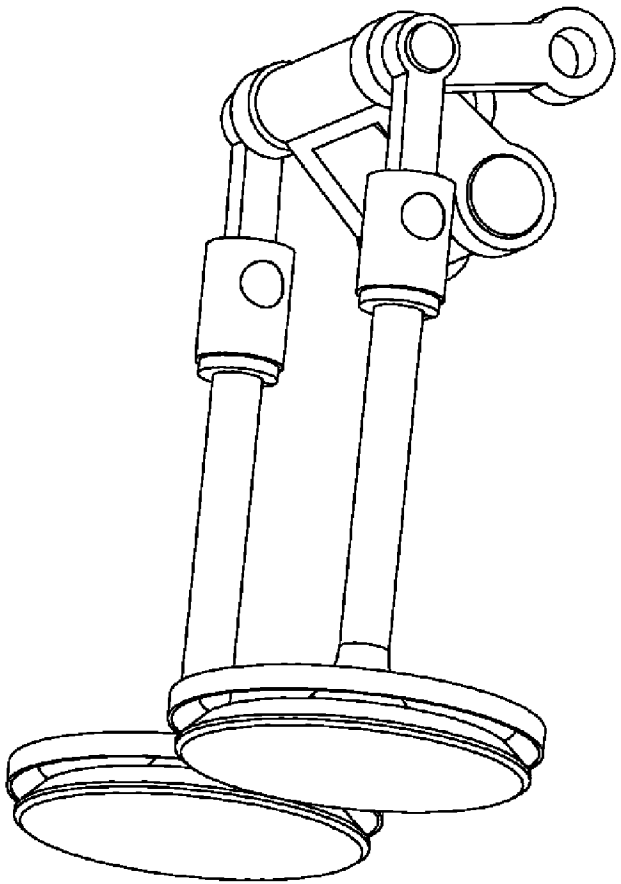
Figure 11:
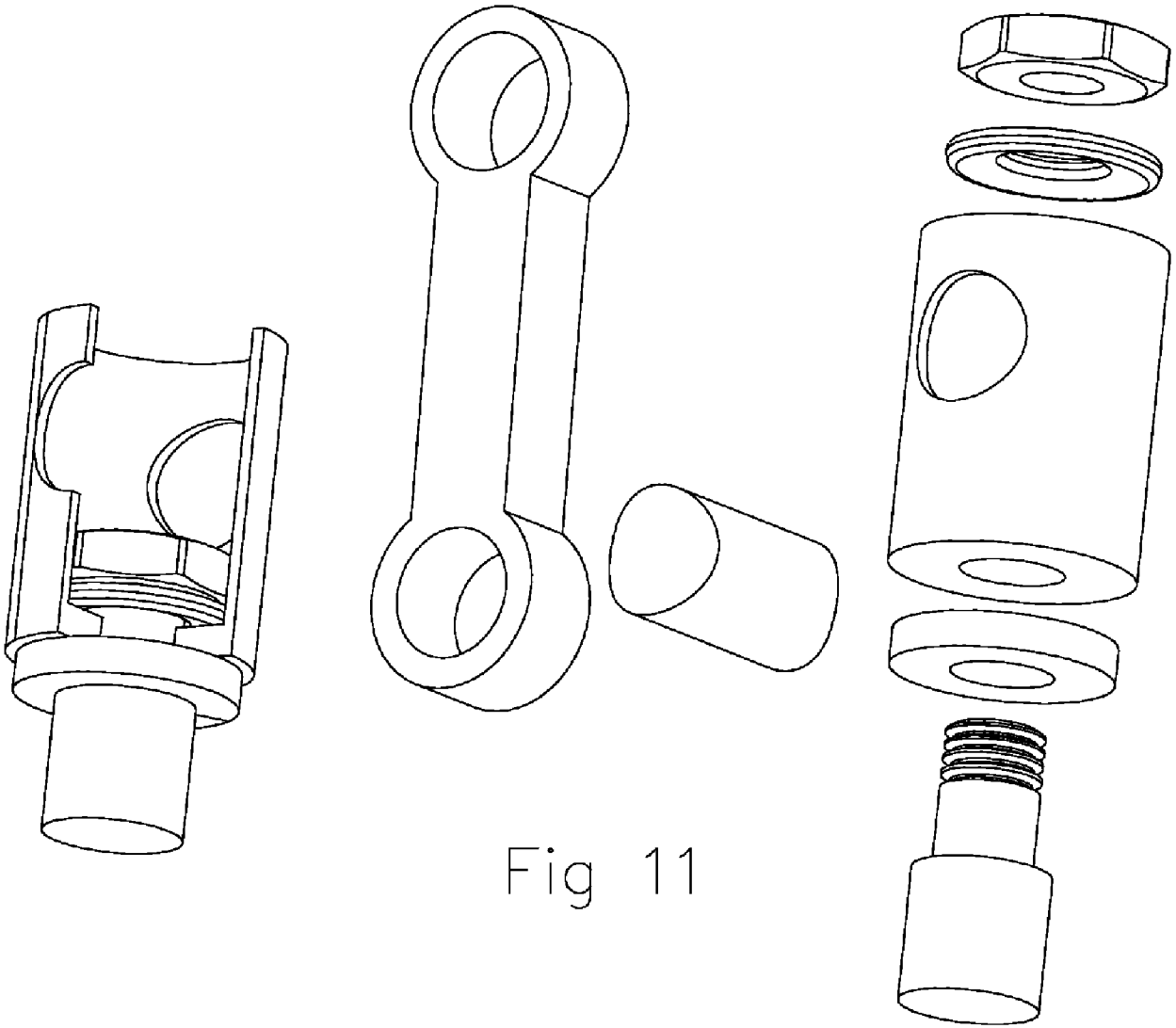
FIG. 11 shows some details of the mechanism of FIG. 3.
Figure 12:
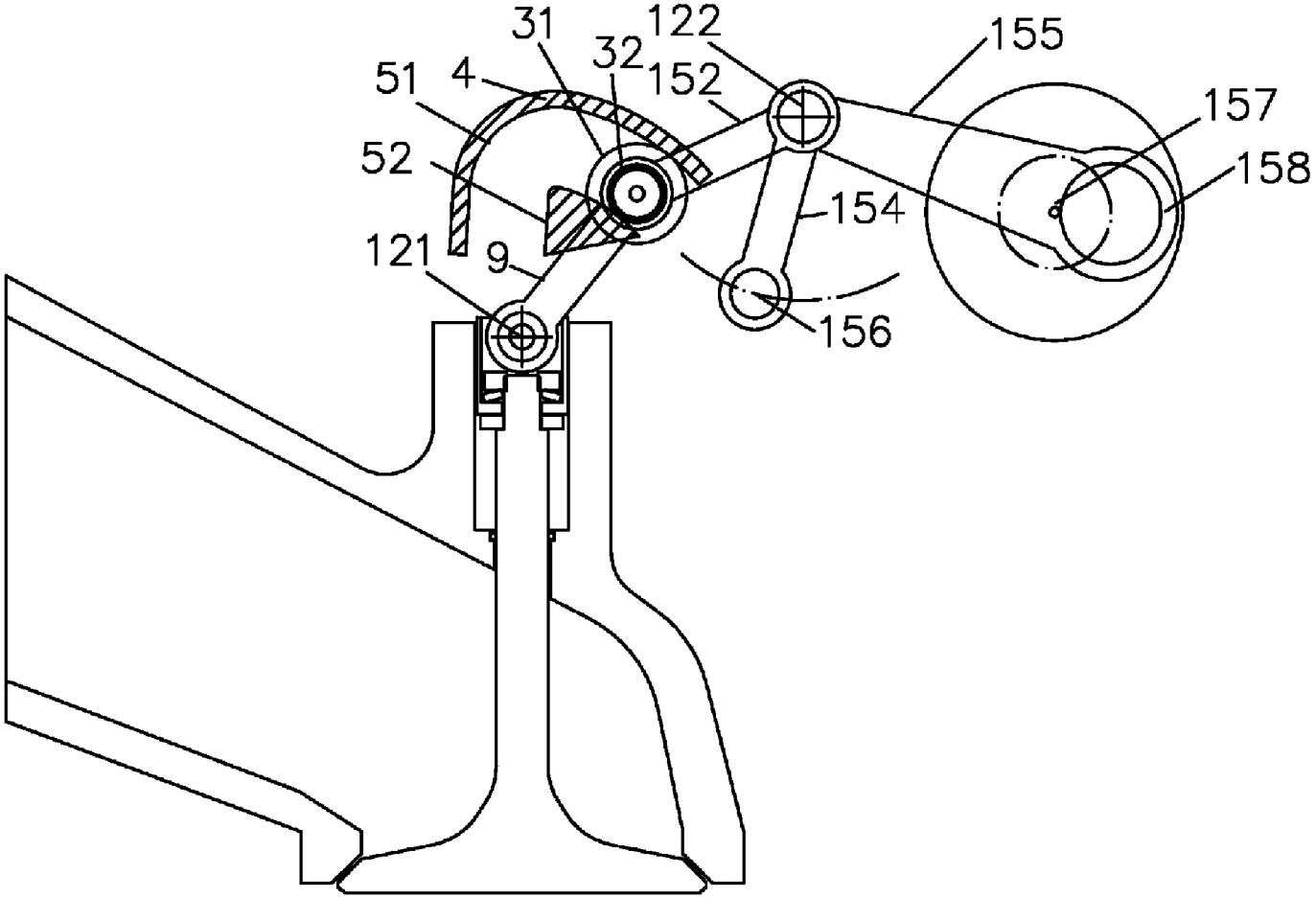
FIG. 12 shows another embodiment.

A simplified version of the system is shown in FIG. 2. The pivot 156, the link 154, the link 9 and the pivot 150 have been removed. The pivot 151 is transferred at the position of the former pivot 150 on the valve actuator 10. The angular displacement of the track 4 changes the valve duration and the valve lift from a maximum to even zero, if desirable. This version cannot provide independent variability for the valve lift and the valve duration. The absence of the links 154 and 9 increases the thrust loads on valve actuator 10 and makes difficult the track geometry, in terms of drive pin acceleration and of surface loading.

The system can easily be adapted to new cylinder head designs.

Figure 19:
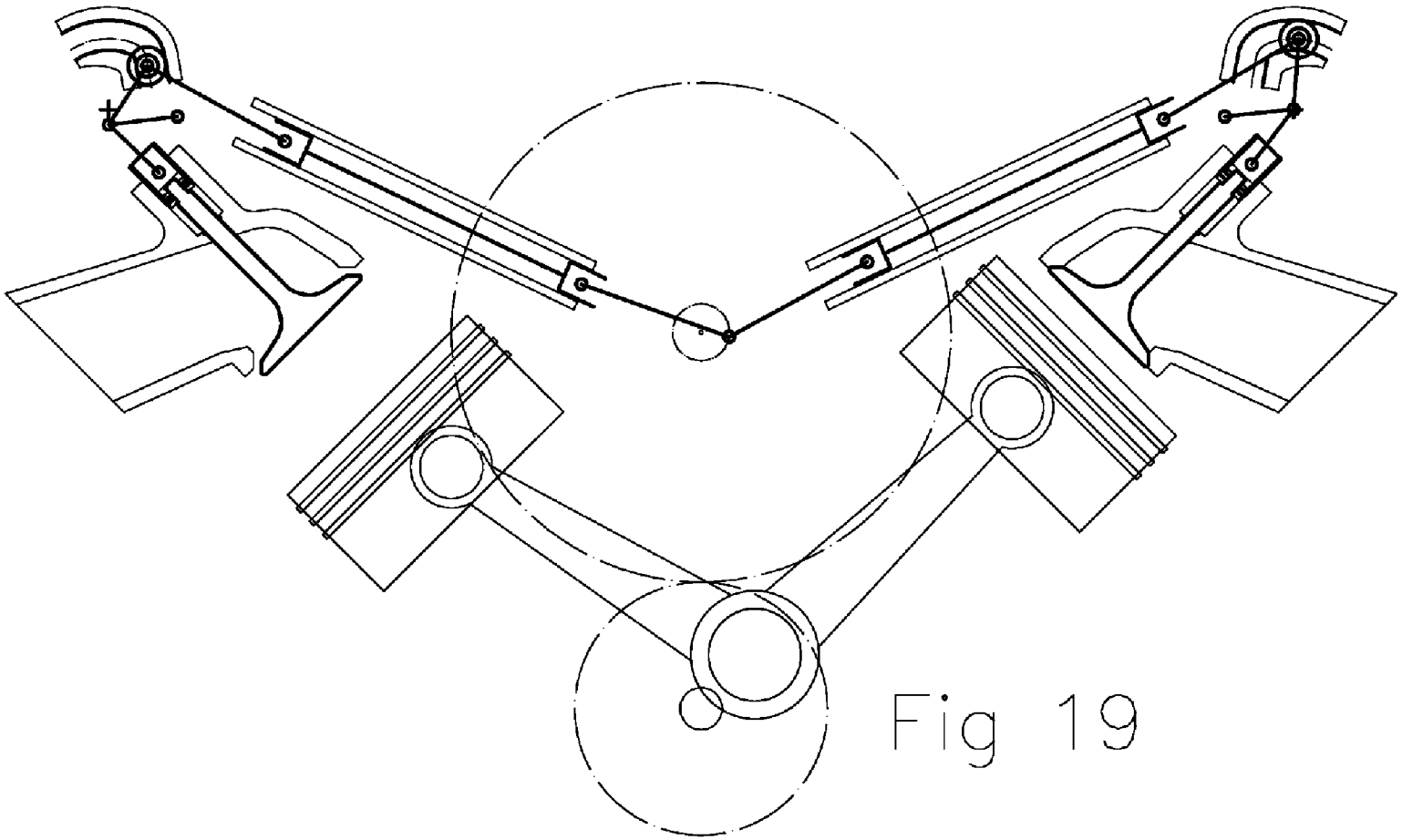
FIG. 19 shows the application of the valve mechanism in a Vee engine.

The system can also be applied on used engines as a retrofit kit, for instance as shown at FIG. 19 wherein a side cam engine is modified.

Various modifications are applicable without departing from the invention.

For instance, the valve actuator 10 can be replaced by a rocker arm pivotally mounted at one end about a constant pivot, holding properly at its other end the valve. In such a case the pivot 150 is secured on the rocker arm.

For instance, instead of the rotating crank 158, an actuation pin can be used to displace the drive pin 31-32 along the track 4, like a linearly reciprocating pin or a pin reciprocating along an arc in synchronization to the engine etc.

Figure 15:
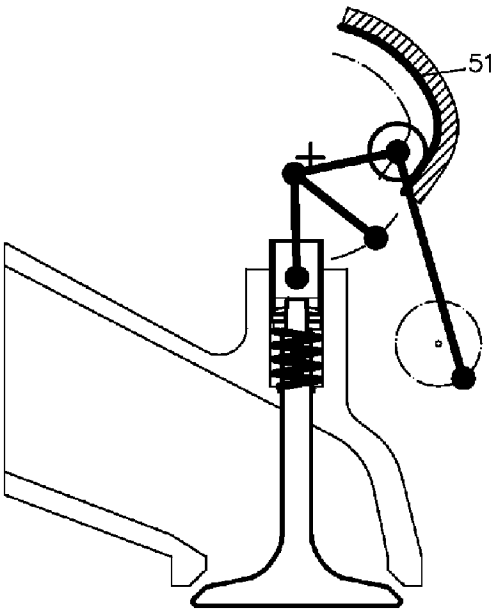

For instance, the track 4 can be replaced by a control surface 51, while a spring restores the valve to the valve seat, to provide a fully variable, but not desmodromic, valve train, like the one in FIG. 15.

Figure 17:
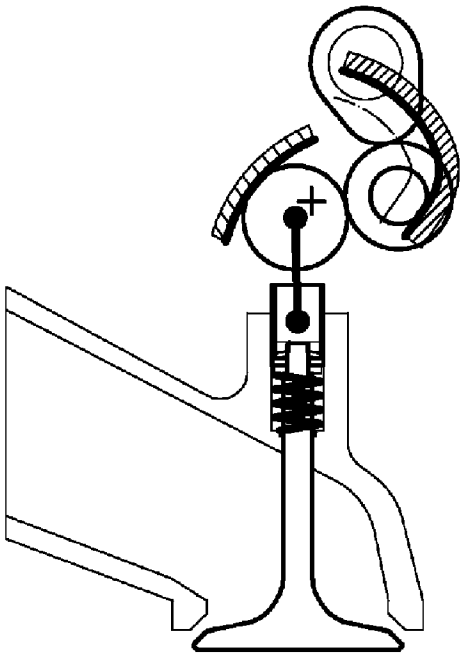
FIGS. 15 to 18 show obvious modifications of the basic mechanism of FIG. 1.
Figure 16:
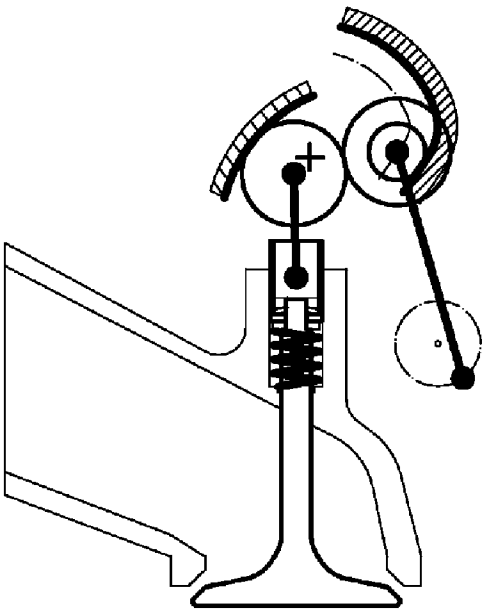
Figure 18:
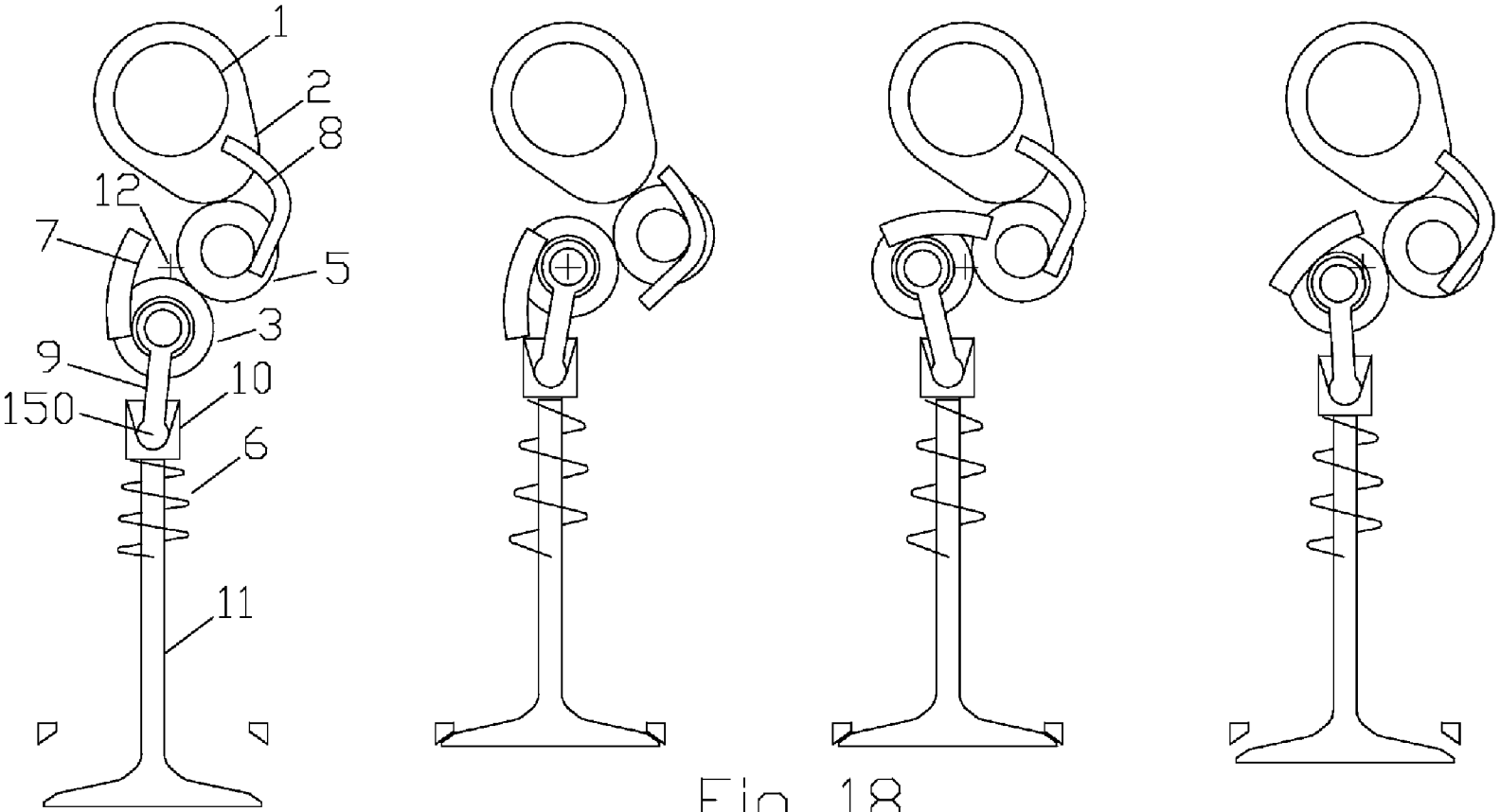

For instance, a pair of rollers 3 and 5, FIGS. 17 and 18, can replace the linkage 152, the first roller 3 rolling along a first control surface 7 that replaces the linkage 154, the second roller 5 rolling along a second control surface 8 that replaces the track 4, while a camshaft 1 with a rotating control cam 2 can replace the crankshaft and the crank. The control cam 2 displaces the roller 5 along the control surface 8, the roller 5 displaces the roller 3 along the control surface 7, so that the valve opens under the action of the control cam 2 and closes under the action of a restoring valve spring 6. Depending on the angular displacement of the control surfaces 7 and 8, the valve lift and the valve duration are continuously and independently variable. FIGS. 15 to 18 show the progressive degradation of the desmodromic mechanism of FIG. 1 to a fully variable, but not desmodromic, valve actuation mechanism like the one described in U.S. patent application Ser. No. 11/759,392. Similarly the valve actuator 10 and the link 9 can be replaced by a rocker arm having a roller thereon, the latter roller being displaced by the roller 3.

Although the invention has been described and illustrated in detail, the spirit and scope of the present invention are to be limited only by the terms of the appended claims.

The invention claimed is:

1. A desmodromic valve mechanism comprising at least:

a valve (11);

a valve actuator (10), said valve actuator (10) being attached adjacent to the valve (11);

a track (4);

a first link (9), said first link (9) being pivotally mounted at one end about a pivot (150) on said valve actuator (10), said link (9) being pivotally mounted at its other end about a pivot (151);

a second link (154), said second link (154) being pivotally mounted at one end about said pivot (151), said second link (154) being pivotally mounted at its other end to a control pivot (156);

a drive pin (31-32), said drive pin (31-32) being engaged in said track (4);

a third link (152), said third link (152) being pivotally mounted at one end about said pivot (151), said drive pin (31-32) being mounted at the other end of said link (152);

an actuation pin (158), said actuation pin (158), via a fourth link (155), displaces said drive pin (31-32) along said track (4), said track (4) comprising a lost motion portion and an actuation portion, so that motion of the actuation pin will cause the linkage to oscillate and the drive pin to perform a reciprocating motion along the track, so that engagement of the lost motion portion of the track by the drive pin will cause the valve to stay closed, so that engagement of the actuation portion of the track by the drive pin will cause the valve to move opening and closing, so that the valve mechanism is rid of inertia loads from moving tracks offering higher revving.

2. A desmodromic valve mechanism according claim 1 wherein the control pivot (156) is angularly displaceable about a center (12) to control the valve lift of the valve (11).

3. A desmodromic valve mechanism according claim 1 wherein the track (4) is angularly displaceable about a center (12) to control the valve duration of the valve (11).

4. A desmodromic valve mechanism according claim 1 wherein the control pivot (156) is angularly displaceable about a center (12) and the track (4) is angularly displaceable about the same center (12) to provide independently variable lift and duration to the valve (11).

5. A desmodromic valve mechanism according claim 1 wherein the valve actuator (10) is slidably fitted in a guide (101).

6. A desmodromic valve mechanism according claim 1 wherein the valve actuator (10) comprises lash adjustment means (112, 114) and elastic means (113) to compensate for heat expansion and to assist the sealing between the valve and the seat of the valve, when the valve is closed.

7. A desmodromic valve mechanism according claim 1 wherein the valve actuator (10) is a valve lever pivotally mounted at one end and attached adjacent at the other end to the stem of the valve (11).

8. A valve mechanism comprising at least:

a valve (11);

restoring means (6) to restore said valve (11);

a valve actuator (10), said valve actuator (10) being attached adjacent to the valve (11);

a control surface (51);

a first link (9), said first link (9) being pivotally mounted at one end about a pivot (150) on said valve actuator (10), said link (9) being pivotally mounted at its other end about a pivot (151);

a second link (154), said second link (154) being pivotally mounted at one end about said pivot (151), said second link (154) being pivotally mounted at its other end to a control pivot (156);

a drive pin (31-32), said drive pin (31-32) rolling along said control surface (51);

a third link (152), said third link (152) being pivotally mounted at one end about said pivot (151), said drive pin (31-32) being mounted at the other end of said link (152);

an actuation pin (158), said actuation pin (158), via a fourth link (155), displaces said drive pin (31-32) along said control surface (51), said control surface (51) comprising a lost motion portion and an actuation portion, so that motion of the actuation pin will cause the linkage to oscillate and the drive pin to perform a reciprocating motion along the control surface, so that engagement of the lost motion portion of the control surface by the drive pin will cause the valve to stay dosed under the action of the restoring means, so that engagement of the actuation portion of the control surface by the drive pin will cause the valve to move opening, so that the angular displacement of the control surface and of the control pivot will vary the valve duration and the valve lift of the valve.

9. A valve mechanism comprising at least:

a camshaft (1);

a control cam (2) mounted on said camshaft (1);

a valve (11);

restoring means (6) to restore said valve (11);

a valve actuator (10), said valve actuator (10) being attached adjacent to the valve (11), said valve actuator (10) being slidably fitted in a guide;

a first control surface (7) angularly displaceable about a center (12);

a first roller (3);

a link (9), said link (9) being pivotally mounted at one end about a pivot (150) on said valve actuator (10), said first roller (3) being mounted at the other end of said link (9), said first roller (3) roiling along said first control surface (7);

a second control surface (8) angularly displaceable about the center (12);

a second roller (5), said second roller (5) being engaged between said second control surface (8), said control cam (2) and said first roller (3);

so that the rotation of the control cam, by means of the rollers and of the control surfaces, cause the valve to open, so that the valve duration and the valve lift vary continuously and independently according the angular displacement of the first control surface and of the second control surface.

* * * * *